United States Patent [19]

Charles

[11] 4,037,381

[45] July 26, 1977

[54] BUILDING PANEL

[76] Inventor: Fred J. Charles, 9112 Lubec St., Downey, Calif. 90240

[21] Appl. No.: 667,652

[22] Filed: Mar. 17, 1976

[51] Int. Cl.[2] ..... E04C 2/28; E04C 2/46

[52] U.S. Cl. ..... 52/627; 52/281; 52/315; 52/489; 52/509; 52/601; 52/612; 52/622

[58] Field of Search ..... 52/620, 622, 627, 612, 52/509, 753 W, 267, 315, 624, 601, 281, 483, 489

[56] References Cited

U.S. PATENT DOCUMENTS

| | | | |
|---|---|---|---|
| 2,066,006 | 12/1936 | Kellogg | 52/489 X |
| 2,120,049 | 6/1938 | Winship | 52/753 W |
| 2,218,965 | 10/1940 | Young et al. | 52/612 X |
| 2,271,584 | 2/1942 | Fellom | 52/489 |
| 3,047,985 | 8/1962 | Murphy | 52/483 |
| 3,308,590 | 3/1967 | Ettore et al. | 52/483 X |
| 3,378,969 | 4/1968 | Larger | 52/624 X |
| 3,381,483 | 5/1968 | Huthsing, Jr. | 52/601 X |
| 3,394,523 | 7/1968 | Sackett, Sr. | 52/483 X |
| 3,429,090 | 2/1969 | Motelnick | 52/489 X |
| 3,555,763 | 1/1971 | Bloxom | 52/601 X |
| 3,608,266 | 9/1971 | Satkin et al. | 52/486 X |
| 3,760,540 | 9/1973 | Latoria | 52/601 X |
| 3,826,055 | 7/1974 | Bobzin | 52/483 |
| 3,852,927 | 12/1974 | Birum, Jr. | 52/483 X |

FOREIGN PATENT DOCUMENTS

| | | | |
|---|---|---|---|
| 579,608 | 7/1958 | Italy | 52/483 |

OTHER PUBLICATIONS

"Stucco Textures and Finishes" 4/15/68 John J. Bucholtz pp. 23-25.

*Primary Examiner*—Leslie Braun
*Attorney, Agent, or Firm*—Fulwider, Patton, Rieber, Lee & Utecht

[57] ABSTRACT

A building panel constituting a prefabricated module for attachment to adjacent studs of a building wall. When used in substitution for conventional stucco construction, the metal frame of the panel is filled with cement stucco. Tabs on the sides of each panel include inwardly projecting legs nailable to the sides of the adjacent studs for concealed attachment. The legs are all laterally offset from the panel sides in the same direction, for nailing from the same direction, and they are also longitudinally or vertically offset so that like panels can be successively butted together at their side edges without interference between the legs of the respective tabs. The panel can also be provided with connection brackets for attachment to the top or bottom plates of a building wall. In normal use the panels are vertically oriented, but they are adapted for transverse mounting to the building wall studs and headers in certain situations.

4 Claims, 7 Drawing Figures

BUILDING PANEL

BACKGROUND OF THE INVENTION

1. Field of the Invention

The present invention relates to modular building construction, and more particularly to a prefabricated building panel having attachment tabs which can be nailed to the sides of usual building wall studs.

2. Description of the Prior Art

The construction of an exterior stucco wall using current techniques is a tedious, time consuming and expensive procedure. After the usual upright wooden studs have been erected, a base must be provided onto which the cement stucco can be applied. In a typical procedure tie wires are attached to the studs, crisscrossing the spaces between the studs, and waterproof paper is then nailed to the studs over the wires. Next, a wire mesh is nailed to the studs over the paper to provide anchorage for a first or scratch coat of stucco. This takes as much as three days to cure and usually there is an accompanying building inspection. A second layer or "brown" coat is then applied to bring the stucco to the approximate thickness desired. Curing and inspection of this layer takes approximately eight more days. Finally, the finish or color coat of stucco is applied to provide the proper color, texture and finish which requires a curing time of one hour and yet another building inspection.

There are a number of variations of the foregoing procedure, but most prior art stucco construction techniques are generally similar, each requiring numerous inspections, extended curing times, skilled labor, and material wastage on the job site, as well as scaffolding.

SUMMARY OF THE INVENTION

According to the present invention, a building panel is prefabricated away from the building site, under controlled conditions, out of the weather, and with only a single inspection required.

In view of the fact that most wooden stud walls have the studs located 16 inches on center, the present panel is made 16 inches wide to serve as a standard stucco building module. Although the panel can be made in any width, the 16 inch width is particularly well adapted for outside cement stucco panels. The weight is such that two men can handle such a panel and, as will be seen, the panel attachment tabs provide good support for that amount of weight.

Although cement stucco walls are a natural application for the present building panels, the building material of the panel can be varied to suit the particular application.

The present panel comprises a rectangular metal frame adapted to span the building studs. The frame provides a boundary for the cement stucco building material, and is also rigidified by the stucco to define a rugged, monolithic structure resistance to shipping abuse and characterized by long service life. In this regard, the stucco is perferably reinforced by other materials embedded therein.

The panel includes a plurality of metal tabs welded or riveted to the longer sides of the metal frame at vertically spaced intervals. Each tab includes an inwardly bendable leg for location against the side of an adjacent building stud. All of the legs are laterally offset in the same direction for nailing to the stud sides from the same direction, and the legs at opposite sides of the panel are also vertically offset so as not to interfere with the legs of an adjacent, abutting panel.

This arrangement permits concealed attachment of the panels to the studs and the metal of the tab legs is preferably thin enough to be nailed through without preformed openings.

The panel construction is extremely inexpensive, utilizing a minimum number of metal tabs spot welded or riveted to the panel frame in a mass production operation.

The thin material of the tabs can be sawed through, if desired, to effect quick removal of a panel for access to plumbing, electrical wiring or the like. Moreover, the panel itself can be cut with a masonry blade to fit into certain constricted areas.

Although the panel is uniquely adapted for vertical orientation and attachment to adjacent building studs, it can be transversely oriented for specialized applications.

Other objects and features of the invention will become apparent from consideration of the following description taken in connection with the accompanying drawings.

DESCRIPTION OF THE PREFERRED EMBODIMENT

Figure 1:
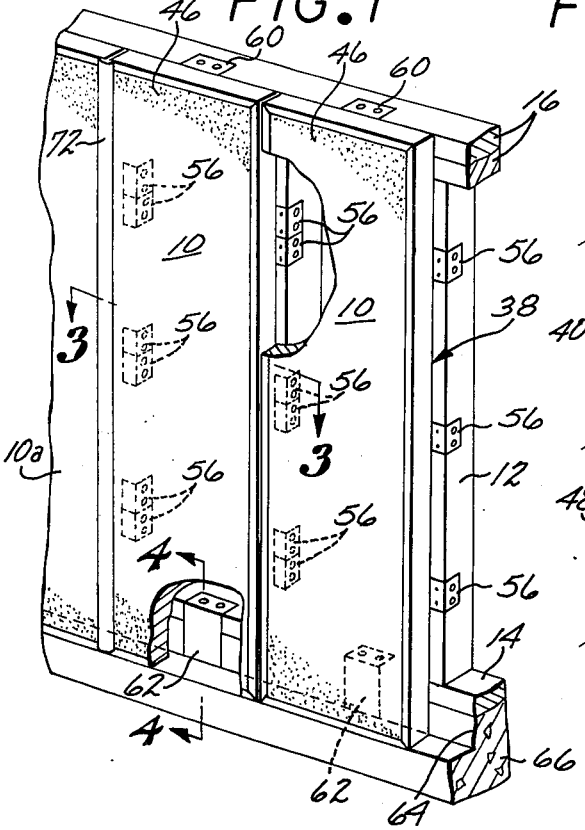
FIG. 1 is a perspective view of a plurality of building panels, according to the present invention, illustrated as they would appear on being attached to a building wall of wooden studding.

Referring now to the drawings, there is illustrated a building panel 10, according to the present invention, adapted to be attached to the structure of a building to form an exterior stucco wall, as will be seen.

The structure of a typical wooden building wall includes a plurality of elongated, vertically orientated or upright 2 × 4 studs 12 nailed to a bottom plate 14 and to a pair of superposed top plates 16. The studs 12 and plates 14 and 16 are nominally 2 inches thick and 4 inches wide, and the studs 12 are usually spaced on 16 inch centers.

Figure 7:
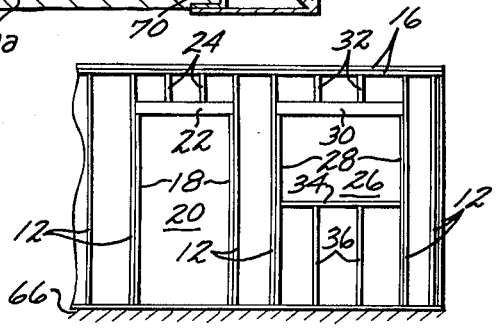
FIG. 7 is a front elevational view illustrating, in simplified form, a typical arrangement of framing members in a building wall having usual wooden studding.

In FIG. 7, a series of vertical studs 12 are illustrated to show a typical building wall construction. In such a construction it is also typical to utilize trimmers 18 nailed to a pair of the studs 12 to define the sides of each door opening 20. The top of the opening 20 is defined by a header 22 connected by a plurality of cripplers 24 to the top plates 16. In similar fashion a typical window opening 26 is defined by side trimmers 28, a header 30, a plurality of cripplers 32, a window plate 34, and a second plurality of cripplers 36.

Also typical in a usual building wall is a spacing of 8 feet between the bottom of the bottom plate 14 and the top of the uppermost plate 16. Accordingly, the building panels 10, which are usually used in a vertical orientation, are made at least 8 feet in length, and preferably longer so that they extend downwardly below the bottom plate 14. To span the studs 12 the panels 10 are preferably 16 inches in width.

The panels 10 are also adapted to be oriented transversely to overlie areas such as those above and below standard door and window openings such as the openings 20 and 26. Thus, to cover the space above the door opening 20, a 16 inch panel 10 is cut to the appropriate length and nailed over the header 22, the cripplers 24, and the upper plates 16. The 16 inch space covered leaves a standard door opening height of 6 feet 8 inches below it.

A similar transverse orientation of a panel 10 can be used to cover the space above the window opening 26, with the panel 10 overlying the header 30, plates 16 and cripplers 32. The space below the window opening could similarly be covered by a pair of superposed transverse panels 10.

Figure 5:
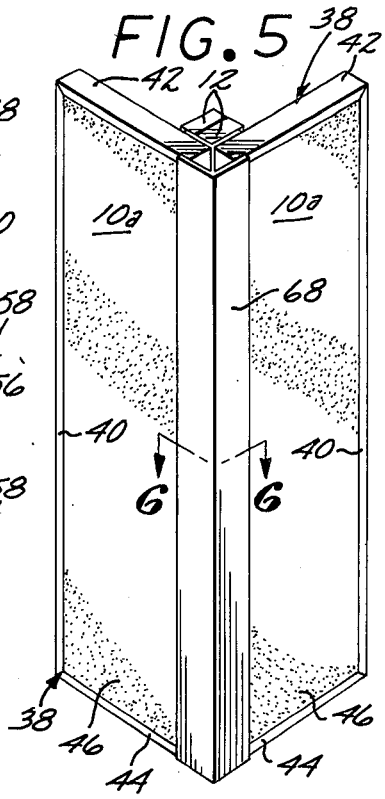
FIG. 5 is a top perspective view of two special corner panels, narrower than the panels of FIG. 1, illustrating how the same would be connected by a corner fitting.

In standard wooden framing construction it is also typical for the studs 12 adjacent the corners of the building to be spaced from a corner a distance of approximately 4½ inches. At such a corner, as best seen in FIG. 5, a pair of closely spaced corner studs 12 are often used. To span the space from the corner to the next stud 4½ inches away a building panel 10*a* is preferably utilized which is identical in every respect to the standard panel 10, except that its width is 4½ inches rather than the standard 16 inches.

It will be understood, of course, that the dimensions used in this description are merely exemplary, being selected solely because they are typcial. The panel of the present invention can be varied in dimension to suit the particular application. Likewise, although the panel could be used in substitution for various types of exterior walls, it is particularly suited to replace the usual cement stucco wall, which is so tedious and time consuming to construct.

Each panel 10 is monolithic and can be fabricated anywhere for transportation to the building site. Preferably each panel 10 is made of a size and thickness that it can be lifted and located in position by two men for nailing to the wooden framing of the building wall.

Figure 2:
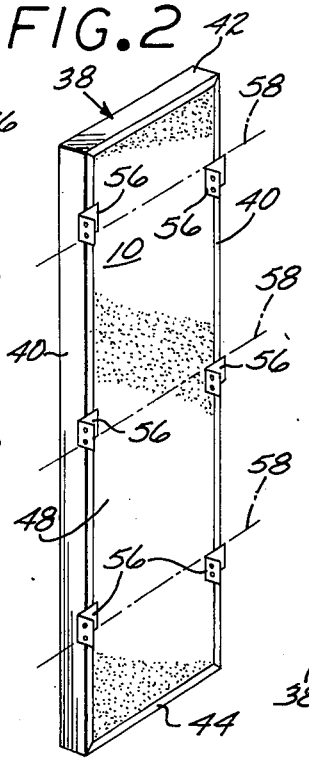
FIG. 2 is a perspective view of one of the panels of FIG. 1, as viewed from the interior.
Figure 3:
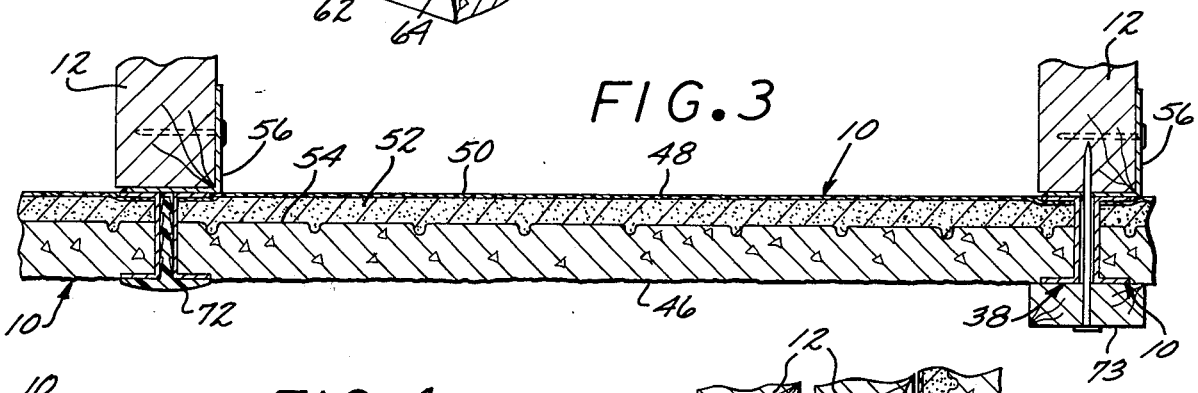
FIG. 3 is an enlarged cross section taken along the line 3—3 of FIG. 1.

Each panel 10 comprises a rectangular metal frame 38, as best seen in FIG. 2, defined by a pair of side members 40, a top member 42, and a bottom member 44. The members 40 are spaced apart to overlie studs 12 spaced on 16 inch centers. Each of the frame members is generally channel shaped in configuration to provide facing flanges on the opposite faces of the panel. Any suitable building material can be used to fill the frame 38 to provide a desired exterior surface 46 and interior surface 48. However, in forming a stucco wall, such as illustrated in FIG. 3, the frame 38 is placed on a suitable support (not shown), and a rectangular sheet of waterproof material such as felt paper 50 is placed in the frame. Cementitious material such as cement stucco 52 is poured onto the paper 50, and a rectangular sheet of usual and conventional rib lath 54 is then set on top of the layer of poured stucco. Finally, another layer of stucco is poured onto the lath 54 to form the exterior surface 46 of the panel.

When the stucco 52 is cured or set, the panel 10 can be transported without affecting its structural integrity. In special situations where it may be necessary to cut odd widths or lengths of the panel 10, the panel can be cut with a usual masonry blade or the like, as will be apparent to those skilled in the art.

The means utilized to fasten the panels 10 and 10*a* to the wooden framing members comprise a plurality of rectangular metal tabs 56 vertically spaced along and spot welded or riveted to the frame side members 40, as best seen in FIG. 2. The tabs 56 on one side of the frame 38 are longitudinally, that is vertically, offset relative to the tabs 56 on the other side of the frame 38, and the upper edges of the tabs 56 on one side member 40 are transversely aligned with the lower edges of the tabs 56 on the opposite side members 40, as indicated by the phantom lines 58 of FIG. 2.

The tabs 56 are preferably made of relatively thin galvanized sheet metal such as 22 or 24 gauge. Preferably the tabs 56 are arranged flat against the adjacent interior surfaces 48 of the panels 10 to facilitate shipment. The tabs 56 are then bent at the job site for attachment to the studs 12, as will be seen. The location of the bends will vary somewhat to compensate for discrepancies in spacing between the studs 12. In the various figures the tabs 56 are already shown bent.

Bending of each tab 56 provides an attachment leg extending inwardly and at an approximate right angle relative to the panel interior surface 48. The attachment legs of all tabs 56 are offset laterally and in the same direction relative to their associated side members 40, as best seen in FIG. 2. Thus, in FIG. 2 the tab legs are offset to the left with respect to both of the side members 40, the purpose of which will become apparent.

Figure 4:
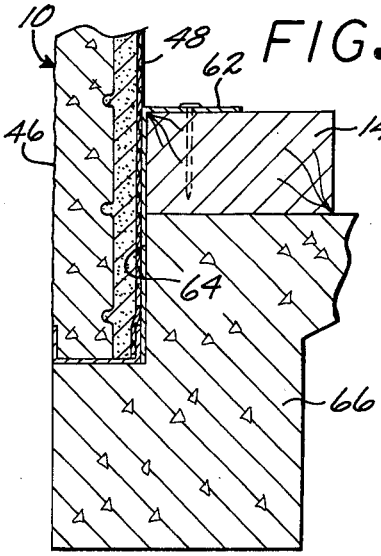
FIG. 4 is an enlarged cross section taken along the line 4—4 of FIG. 1
Figure 6:
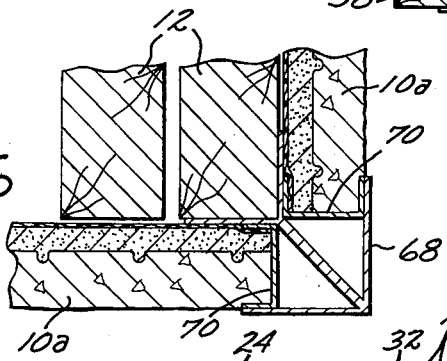
FIG. 6 is an enlarged cross sectional view taken along the line 6—6 of FIG. 5.

Attachment of the panels 10 and 10*a* to the studs 12 by the tabs 56 in some instances provides sufficient support, but it is preferred to provide additional attachment means. More particularly, a metal upper connection bracket 60 identical to one of the tabs 56 is spot welded or riveted to the frame top member 42. The attachment leg of bracket 60 is made such that it can be inwardly bent to overlie the uppermost top plate 16, as seen in FIG. 1. If desired, still further support can be provided by spot welding or riveting a metal lower connecton bracket 62 to the bottom frame member 44, as best seen in FIG. 1. Each bracket 62 is substantially identical to one of the tabs 56, except that the brackets 62 are longer in a vertical direction. Thus, when each bracket 62 is right angularly bent inwardly to form an attachment leg the leg will be located above the frame bottom member 44 to overlie the bottom plate 14, as best seen in FIG. 4. In such an instance the lower portion of the panel 10 typically would fit within a niche 64 provided in the building slab or foundation 66, although other forms of slab configuration are also typcial, as will be apparent to those skilled in the art.

The panels 10 and 10*a* thus can be fabricated and assembled rapidly and inexpensively to provide identical modular units easily transportable to a building site.

In erecting a stucco wall according to the present invention, the operation is begun at a corner of the building. An aesthetically attractive appearance at the corners is preferably provided by utilizing a special corner extrusion fitting 68 to define a pair of vertically oriented receiving channels 70 disposed at right angles relative to each other. These channels 70 are each adapted to receive a side of the panel frame 38. The fitting 68 is attached in any suitable fashion (not shown) to the pair of corner studs 12.

Starting at the left corner of the building wall, as seen in FIG. 1, viewed from the exterior, a narrow panel 10*a* is fitted into the adjacent channel 70 of the fitting 68, with the tabs 56 (not shown) on that side bent flat against the interior surface 48 of the panel 10*a* so as not to be in the way. The opposite tabs 56 at the right or other side of the panel 10*a* are then bent inwardly and over the adjacent stud 12 and nailed to the right side of the stud. This is the stud located approximately 4½ inches from the corner. The brackets 60 and 62 are next nailed to the top and bottom plates 14 and 16, respectively. The relative thinness of the tabs 56 and brackets 60 and 62 makes them not only easily bendable, but allows common nails to be driven through the material without any necessity for pre-drilled openings.

Next, a 16 inch or full-width building panel 10 is disposed to the right of the mounted panel 10*a*. The tabs 56 on its left side are vertically offset relative to the tabs 56 on the right side of the already placed panel 10*a*, and will lie below them, as best seen in FIG. 1. The tabs 56 of the panel 10 are then bent inwardly and over the right side of the stud 12, the same side as the tabs 56 of the panel 10*a*. These are nailed to the stud, and the opposite tabs 56 of the panel 10 are then bent inwardly and nailed to the right side of the next adjacent stud 12 to the right. The brackets 60 and 62 are also nailed in position in the same way as were the corresponding elements of the panel 10*a*.

Successive panels 10 are sequentially mounted across the building wall until the right corner is reached. One of the narrower panels 10*a* is then used to fill the narrow 4½ inch space that is available. This method of mounting desirably conceals all of the fastening means from persons viewing the structure from the exterior.

In some instances the stud spacing may not be exact, in which case a masonry blade can be utilized to cut one of the panels to fit. A cut panel will be without tabs 56 on one side. For attachment, therefore, a masonry drill can be used to provide suitable openings partially through the panel to enable the panel to be nailed to the outer surfaces of the studding. The openings are preferably thereafter filled with suitable caulking material.

The spaces between adjacent building panels can be filled with any suitable caulking material, but preferably these spaces are not only filled but decoratively concealed by molded plastic or metal strips 72 which overlie the spaces. Each strip 72 is characterized by an inwardly projecting bayonet tongue whose deformable corrugations tend to maintain the strip 72 in seated position, as best seen in FIG. 3. Another exemplary strip 73 is also shown in FIG. 3. The strip 73 is commonly referred to as a "batten," and may be a 1 inch by 2 inch strip of wood nailed to the stud 12.

In some instances, after the stucco wall has been in service for some time, it is desirable to obtain access to electrical wiring or plumbing behind one of the panels. For this purpose the strips 72 can be easily removed and a saw utilized to cut thrugh accessible portions of the tabs 56 and brackets 60 and 62. The complete panel can then be removed. Reattachment is conveniently had by drilling suitable openings part way through the panel, and nailing the panel to the underlying studs 12, as previously mentioned in connection with odd width panels.

From the foregoing it is seen that a modular stucco panel is provided which can be quickly mounted to standard wooden studding by metal tabs easily bendable to exactly locate them in conformity with the existing spacing between the studs. The relatively thin character of the tabs and related attachment elements allows common nails and the like to be easily driven through them.

Various modifications and changes may be made with regard to the foregoing detailed description without departing from the spirit of the invention.

I claim:

1. A building panel comprising:

a rectangular metal frame adapted to span adjacent studs of a building wall and including a pair of side members each adapted to overlie a portion of the width of one of the adjacent studs;

building material filling said frame and defining exterior and interior faces; and a plurality of metal tabs spaced along and fastened to said side members and each including an attachment leg bent inwardly of and at a right angle relative to said interior face, said legs each having an upper edge and a lower edge, the upper edges of said legs on one of said side members being transversely aligned with the lower edges of said legs, respectively, on the other of said side members whereby said building panel is properly aligned with an adjacent, like building panel upon engagement between said upper edges of said building panel and said lower edges of the adjacent building panel, each of said legs being offset laterally, to one side of the associated one of said side members whereby each of said legs is adapted for orientation upon and securement to the side of a building stud.

2. A building panel according to claim 1 wherein said frame includes a top member;

a metal upper connection bracket fastened to said top member and including an attachment leg bendable inwardly at a right angle relative to said interior face whereby said attachment leg of said upper connection bracket is adapted for orientation upon and securement to the upper side of the top plate of a building wall.

3. A building panel according to claim 1 wherein said frame includes a bottom member;

a metal lower connection bracket fastened to said bottom member and including an attachment leg bendable inwardly at a right angle relative to said interior face, said attachment leg of said lower connection bracket being offset upwardly relative to said bottom member whereby said attachment leg of said lower connection bracket is adapted for orientation upon and securement to the upper side of the bottom plate of a building wall.

4. A building panel according to claim 1 wherein said metal tabs are made of sheet metal sufficiently thin that common nails can be driven therethrough.

* * * * *